US005458030A

United States Patent [19]

Betts

[11] Patent Number: 5,458,030

[45] Date of Patent: Oct. 17, 1995

[54] SCREWDRIVERS

[76] Inventor: Geoffrey Betts, 'Sunfield', High Street, Whitwell, near Worksop, England

[21] Appl. No.: 147,728

[22] Filed: Nov. 2, 1993

[30] Foreign Application Priority Data

Nov. 4, 1992 [GB] United Kingdom ..... 9223045

[51] Int. Cl.[6] ..... B25B 23/08

[52] U.S. Cl. ..... 81/451; 81/58.1

[58] Field of Search ..... 81/58.1, 177.1, 81/435, 451, 452

[56] References Cited

U.S. PATENT DOCUMENTS

| | | | |
|---|---|---|---|
| 2,688,991 | 9/1954 | Doyle | 81/452 |
| 3,361,169 | 1/1968 | Charchenko | 81/451 |
| 3,392,767 | 7/1968 | Stillwagon | 81/451 |
| 4,736,658 | 4/1988 | Jore . | |
| 4,800,788 | 1/1989 | Goldstein | 81/451 |
| 5,029,498 | 7/1991 | Kinsey | 81/451 |

FOREIGN PATENT DOCUMENTS

| | | |
|---|---|---|
| 338554 | 10/1989 | European Pat. Off. . |
| 501883 | 9/1992 | European Pat. Off. . |
| 926360 | 4/1955 | Germany . |
| 3704356A | 8/1987 | Germany . |
| 8803962 | 6/1988 | Germany . |
| 8810923 | 9/1989 | Germany . |
| 230189 | 3/1925 | United Kingdom . |
| 252923 | 8/1926 | United Kingdom . |
| 308955 | 12/1927 | United Kingdom . |
| 414887 | 8/1934 | United Kingdom . |
| 589025 | 6/1947 | United Kingdom . |
| 620451 | 3/1949 | United Kingdom . |
| 797785 | 8/1956 | United Kingdom . |
| 2073638 | 10/1981 | United Kingdom . |
| 2234695 | 2/1991 | United Kingdom . |
| 2251196 | 7/1992 | United Kingdom . |
| WO8304385 | 12/1983 | WIPO . |

*Primary Examiner*—James G. Smith

*Attorney, Agent, or Firm*—Trexler, Bushnell, Giangiorgi & Blackstone, Ltd.

[57] ABSTRACT

A screwdriver, or an adaptor for fitment to a screwdriver, having a shaft portion and drive blade and sleeve device slidably mounted on the shaft portion so that it can extend beyond the end of said drive blade in order to prevent the screwdriver blade from slipping off a screw and to enable the screw to be driven with substantial force from the start. The sleeve may also be rotationally coupled with the shaft portiion.

6 Claims, 4 Drawing Sheets

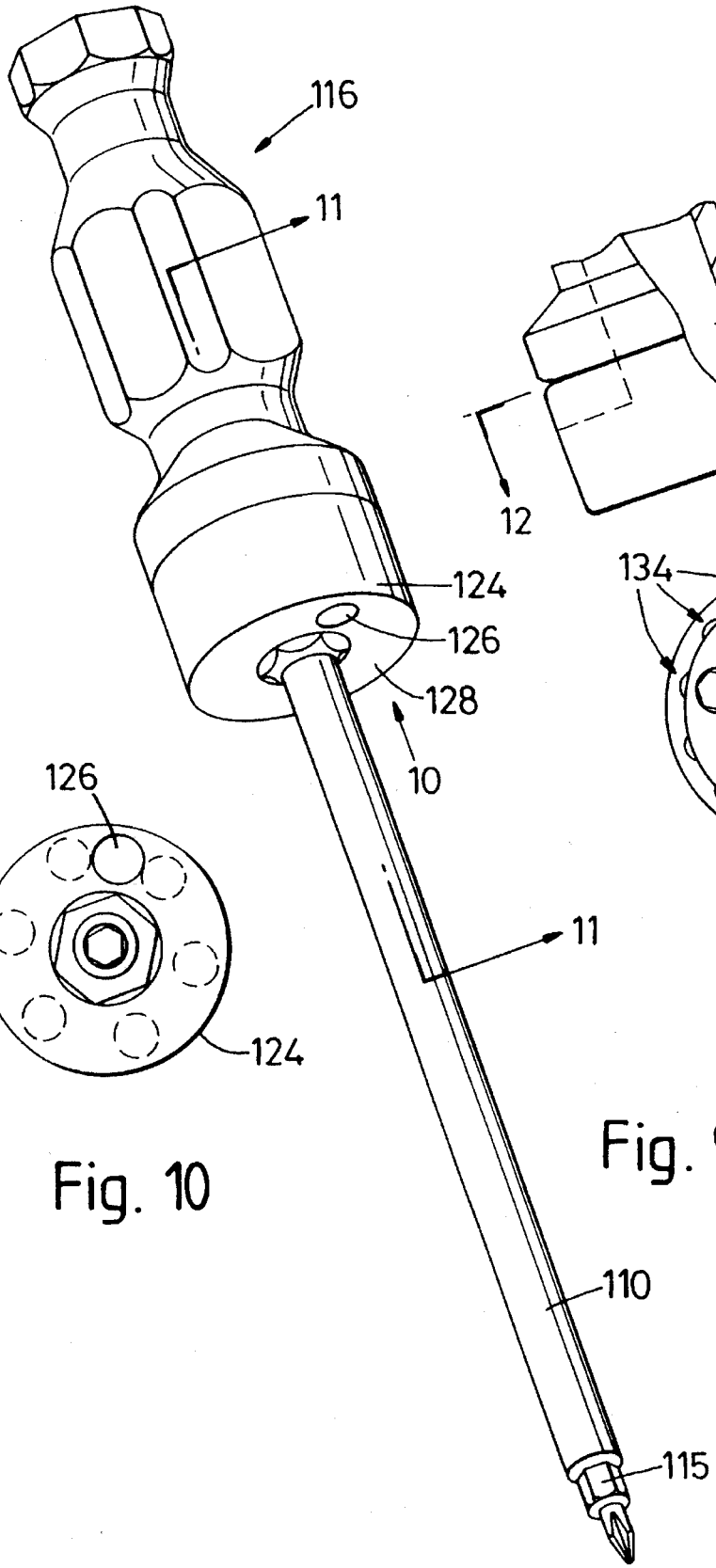
Fig. 9
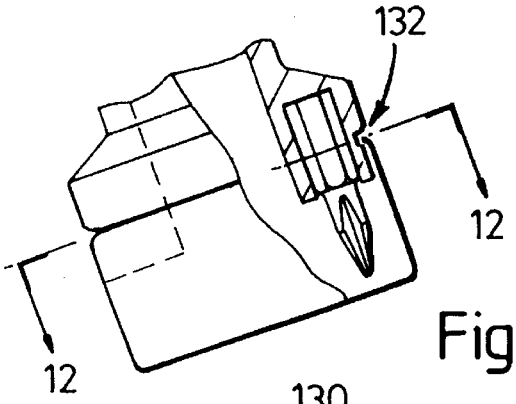
Fig. 11
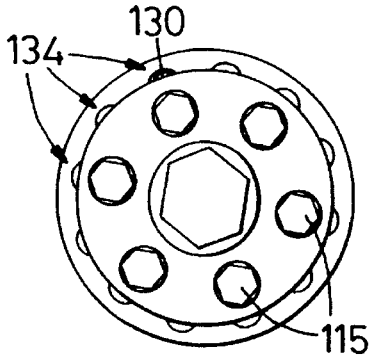
Fig. 12
Fig. 10

SCREWDRIVERS

FIELD OF THE INVENTION

The invention relates to screwdrivers, in particular, although not exclusively, to screwdrivers for driving single slotted screws.

A particular hazard when driving screws of the single slotted variety is that of the blade of the screwdriver slipping off the screw head and scoring the surface of or alongside the member (possibly an expensive hardwood door or the like) into which the screw is being driven. This hazard is much reduced when using screwdrivers of the "Phillips" type to drive screws having a cruciform type of driving slot, but is not entirely eliminated.

A further problem is that, unless a pilot hole has either been drilled or produced by a bradawl for example, a screw cannot easily be started in its required location because any substantial axial force applied to the screw by the screwdriver tends to tilt the screw out of line and to cause the disengagement of the screwdriver and screw.

Sleeve devices have in the past been provided for fitment on screwdriver blades. Such devices have, however, been of only limited assistance in that the screwdriver blade may have been located centrally of the screw head by such a sleeve device but the starting of the screw has not been facilitated thereby.

The object of the invention is to provide a screwdriver with means whereby it will be prevented from slipping off a screw and will enable the screw to be driven with substantial force from the start.

In a screwdriver in which the means referred to for preventing it from slipping off a screw and for enabling a screw to be driven with substantial force from the start are constituted by a sleeve device, a further object of the invention is to enable said sleeve device to be rotationally coupled to a shaft portion of the screwdriver.

SUMMARY OF THE INVENTION

According to the invention, there is provided a screwdriver, or an adaptor for fitment to a screwdriver, having a shaft portion with a blade at one end and having also a sleeve device slidably mounted on said shaft portion between a first position of adjustment in which it extends beyond the end of said drive blade and a second position of adjustment in which it exposes said blade, means being provided whereby, at least when the blade is exposed, said sleeve device is or can be rotatationlly coupled with said shaft portion. Spring means may be provided for urging the sleeve device towards said first position.

The sleeve device may be made of a synthetic plastics material with a metal liner extending at least partly along the length of its bore. The bore of said sleeve device will preferably be a stepped bore, whereby said sleeve device is held captive on the shaft portion of the screwdriver by a greater width of the blade.

Means whereby, at least when the blade is exposed, the sleeve device can be drivably connected to the shaft portion may comprise a driving nut portion provided on said shaft portion and a complementary socket at the rear end of the sleeve device.

A metallic part of the sleeve device may have been magnetised to retain ferrous screws within it by magnetic attraction.

The sleeve device may be adapted for the reception of a plurality of screwdriver bits which can be used selectively.

Reference is made to my co-pending application for patent filed concurrently herewith and concerned with the packaging of hand tools such as the screwdriver described above.

BRIEF DESCRIPTION OF THE DRAWINGS

FIGS. 7 to 12 are views which illustrate different embodiments of the invention.

DESCRIPTION OF THE PREFERRED EMBODIMENT

Figure 1:
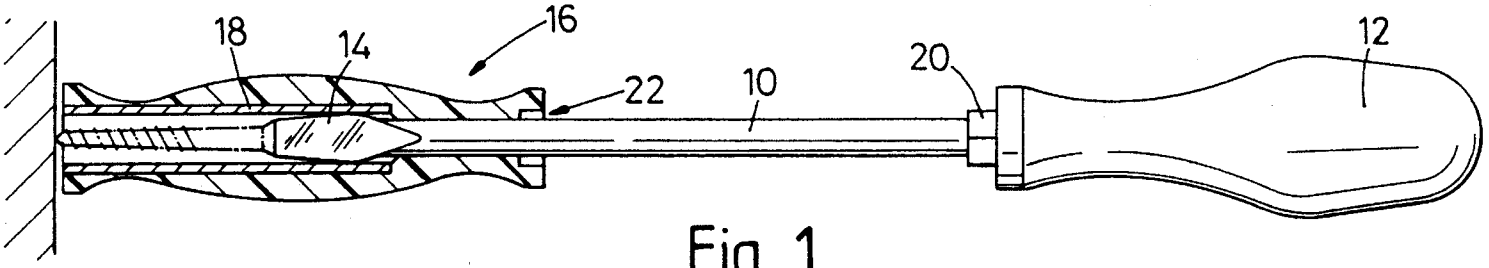
FIG. 1 is a part-sectional view of a screwdriver embodying the invention in one mode of use.

Referring now to FIG. 1, the screwdriver there illustrated has a cylindrical shaft portion 10 with a handle 12 at one end and blade portion 14 at the other.

A sleeve device, generally indicated 16, is freely rotatable on the shaft portion 10. Said sleeve device, made mainly of a synthetic plastics material, has a metal liner 18 which extends rather more than halfway along the length of the device from its end remote from the handle. The sleeve is in fact somewhat longer than a wood screw which is shown in chain-dotted lines within the front end of the sleeve device, the screw being of average length having regard to its diameter. The bore of the sleeve device is a stepped bore so that said sleeve device is held captive on the shaft portion by the widening of the blade.

The underside of the handle 12 is provided with a hexagonal driving nut portion 20 and the rear end of the sleeve device has a hexagonal socket 22 in which said nut portion can be engaged.

The screwdriver is shown in FIG. 1 in a first mode of use, that is to say, with the sleeve in a forward position in which it prevents the screwdriver blade from slipping sideways out of engagement with the screw head. In addition, because the sleeve device shrouds the full length of the screw and extends a somewhat longer distance along the shaft portion of the screwdriver, the screw is supported against any tendency to tilt. Consequently, despite the fact that it is not being started in a pilot hole drilled or formed by a bradawl for example, the screw can be driven hard with substantial axial force without fear of the screw tilting. The average time required to drive each screw can therefore be expected to be much reduced.

Figure 2:
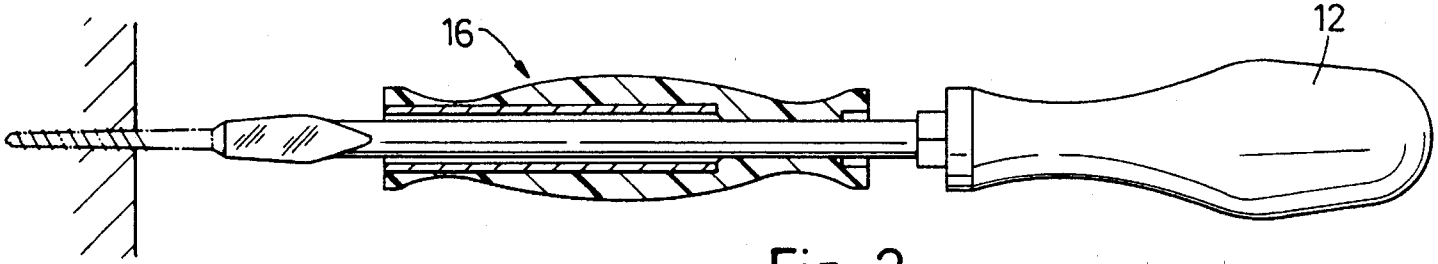
FIGS. 2 and 3 are views illustrating the screwdriver being used in other modes of use.

In FIG. 2, the screwdriver is shown in a second mode of use, the sleeve device having been relocated to a position intermediate the ends of the shaft portion where it can be used as a spinner. In other words, the sleeve device can be held by the user to provide a steady for the screwdriver blade.

Figure 3:
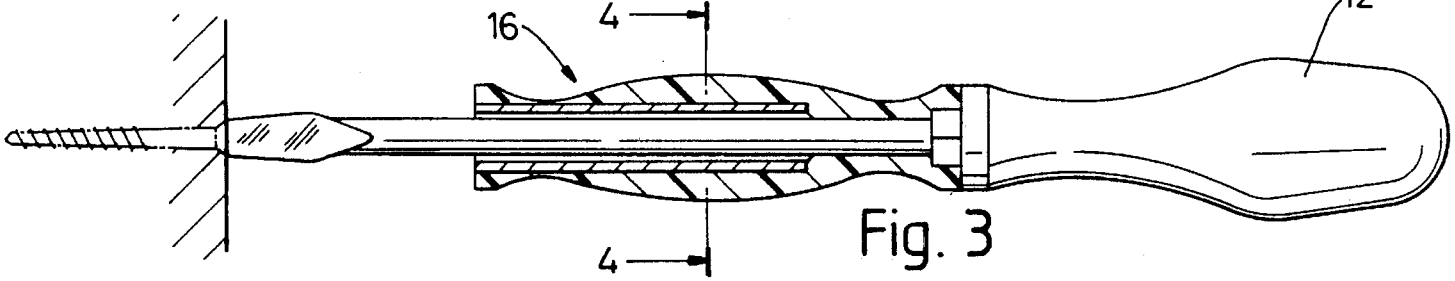
Figure 4:
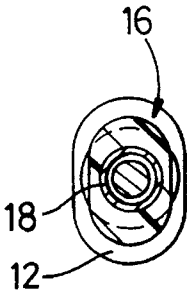
FIG. 4 is a sectional view on the line 4—4 in FIG. 3, FIGS. 5 and 6 are views similar to FIG. 1 and illustrating possible modifications.

In FIG. 3, the screwdriver is shown in a third mode of use when the screw has been almost completely driven into position, that is to say with the sleeve device re-located so that its rear end engages the handle non-rotatably. The user of the screwdriver can thus use both hands for extra torque to drive the screw home. If desired, the sleeve device can be used with a segmental action. In other words, since the sleeve device is of non-circular external shape so as to facilitate the way in which it can be grasped and turned, it can be angularly re-located with the handle after each small turning movement to suit the personal preference of the user. (The screwdriver clan of course be used in reverse, that is to say when unscrewing).

Figure 5:
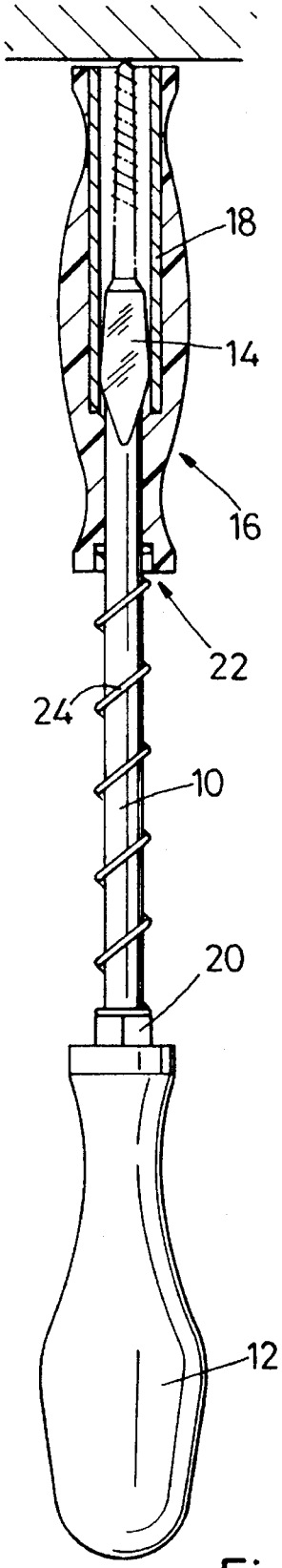

Referring now to FIG. 5, this illustrates a possible modification of the screwdriver of FIGS. 1 to 4, the modification being the provision of a coil compression spring 24 for urging the sleeve device away from the handle 12. The spring 24 embraces the shaft portion 10 of the screwdriver; at one end it abuts against the sleeve device and at its other end it abuts against the driving nut portion 20 at the underside of the handle.

The arrangement is such that this modified form of screwdriver can be used one-handed to insert a screw in an overhead location where this could only otherwise be done with great difficulty (as for example by drilling a pilot hole and starting the screw by hand before using the screwdriver). It will be understood that the spring is a relatively weak spring. That is to say, although it can support the weight of the sleeve device the spring is quite easily compressed by the user as the screw is screwed into position. The spring can be removed when the sleeve device is to be brought into engagement with the driving nut portion 20 at the underside of the handle, the sleeve device in this case not being captive on the shaft portion of the screwdriver.

Other means may be employed to obtain the advantage just described of the FIG. 5 embodiment. For example, means may be provided for producing a very slight resistance to axial sliding of the sleeve device along the cylindrical shaft portion of the screwdriver.

Figure 6:
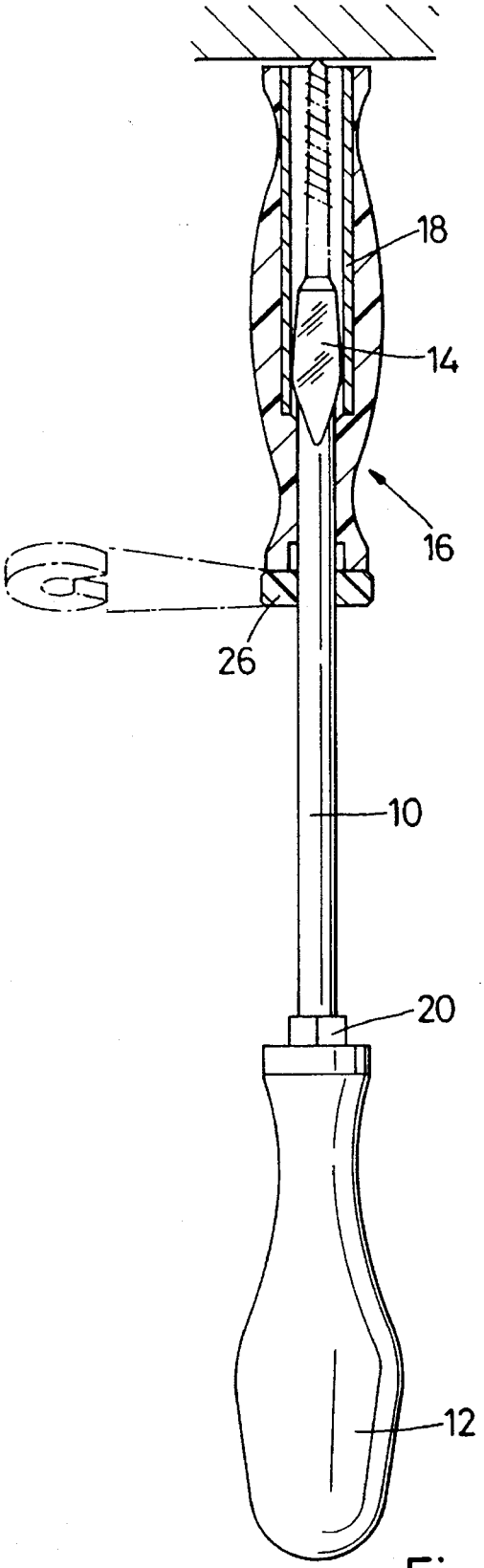

In FIG. 6 there is illustrated the provision of means for producing a resistance to axial sliding of the sleeve device along the cylindrical shaft portion of the screwdriver, these means taking the form of a resilient clip element 26 which can be snap fitted on said shaft portion beneath the sleeve device. Ideally, however, the sleeve device will have means located within its bore for acting very lightly against the cylindrical shaft portion of the screwdriver, this producing an initial resistance to axial sliding of said sleeve device, the fitment of said resilient clip element 26 on said shaft portion then providing a somewhat greater resistance to axial sliding of said sleeve device.

Figure 7:
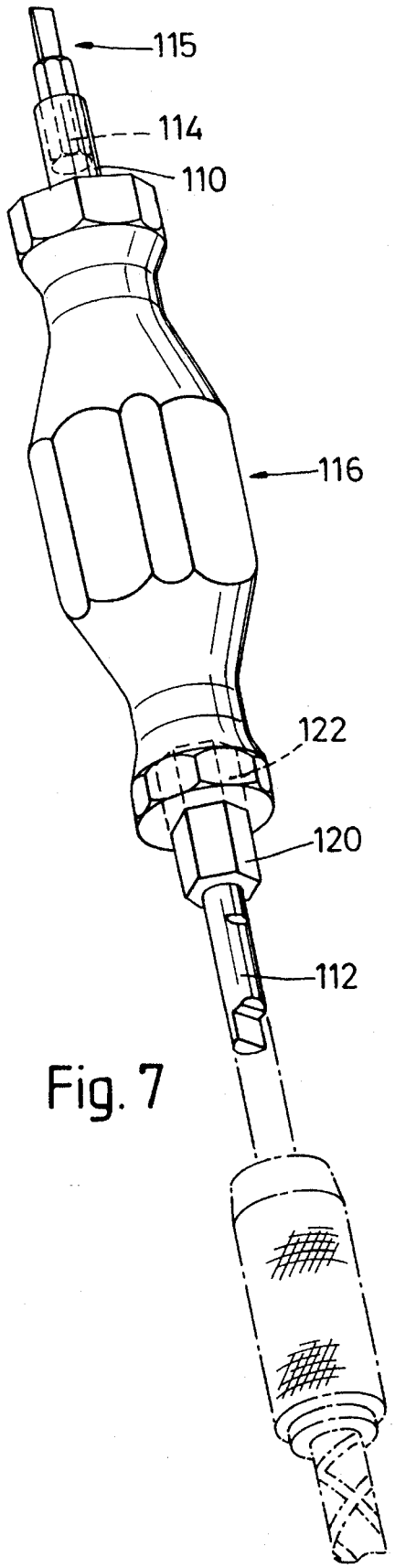

In FIG. 7 there is illustrated a rather different embodiment of the invention, this being an adaptor unit for fitment to a screwdriver. (The screwdriver to which the adaptor unit is shown being fitted in FIG. 7 is a pump action spiral screwdriver but it will be understood that it could equally well be a motor driven screwdriver).

The adaptor unit illustrated in FIG. 7 has a cylindrical shaft portion 110 with a plug-in type adaptor spindle 112 at one end and an axial recess 114 at the other end for the reception of a selected one of a plurality of screwdriver bits 115. The shaft portion 110 has been magnetised to retain the ferrous-screwdriver bit in position.

A sleeve device, generally indicated 116, is freely rotatable on the shaft portion 110 and is of similar form to the sleeve device 16 of the first described embodiment, having a hexagonal socket 122 at its rear end which can be engaged with a hexagonal driving nut portion 120 formed adjacent the adaptor spindle 112 of the cylindrical shaft portion.

The sleeve device of this embodiment can be used in a generally similar way to the sleeve device of the first described embodiment. In an advanced position along the shaft portion, said sleeve device can embrace the screwdriver bit and can contain a screw engaged by said screwdriver bit for the starting of the screw. In an intermediate position, the sleeve device can be used as a spinner for steadying the shaft portion 110 as the latter is rotationally driven by the pump action spiral screwdriver illustrated (or motor driven screwdriver as the case may be). In a fully retracted position as illustrated in FIG. 7, the sleeve device is engaged with the driving nut portion and said sleeve device can then be used for the final tightening of the screw. (In a case where the adaptor unit is fitted to a battery powered screwdriver, it may be that the battery power is not sufficient to tighten the screw and the adaptor unit will be especially useful in such circumstances).

Figure 8:
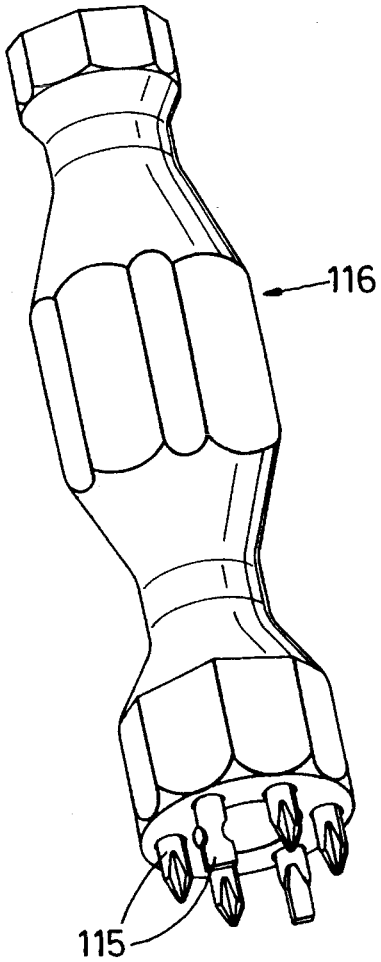

In a further modification illustrated in FIG. 8, the rear end of the sleeve device has been adapted to form a convenient carrier for the plurality of screwdriver bits 115 which can be used selectively in the adaptor unit of FIG. 7. The bits 115 are plugged into respective cavities equally spaced around a pitch circle diameter at the rear end of said sleeve device and retained therein either by being a push fit in their respective cavities or by magnetic means for example.

In FIGS. 9 to 12 there is illustrated a further modification of the sleeve device just described (although in fact in this case the sleeve device has been shown in FIG. 9 to have been fitted to the cylindrical shaft portion 110 for use as a hand held screwdriver the sleeve device having been reversed with respect to the shaft portion). The further modification in this case is the addition of a cylindrical shroud member 124 at the rear end of said sleeve device to retain the plurality of bits 115 in position, the bits thus being able to be loosely located in their respective cavities.

As shown in FIG. 10, which is a view looking in the direction of arrow 10 in FIG. 9, an aperture 126 in an end wall 128 of the shroud member can be brought into line with a required one of the different bits 115 so that it can be allowed to fall into the users hand. To retain the full complement of bits within the sleeve device, the shroud can be located with the aperture 126 midway between an adjacent pair of bit locations as shown in FIG. 10.

Means whereby the shroud member can be "clicked" around to be retained in any required position are shown in FIGS. 11 and 12 and includes a ridge element 130 extending across a circumferential groove 132 surrounding the sleeve device. An inwardly directed flange formed at the end of the shroud member remote from the end wall 128 is snapped in position in the groove 132 and has a plurality of notches 134 which can be engaged in turn by the ridge element 130.

Various other modifications may be made. For example, it is not essential for the sleeve device to be provided with a metal liner, or indeed for the sleeve device to have a stepped bore so as to be captive on the shaft portion. Furthermore, in any of the illustrated embodiments, if the shaft portion was of non-circular cross section, the sleeve device could be of complementary internal shape to be slidably mounted but non-rotatable thereon. The sleeve device would then have only two modes of use and could not be used as a spinner to steady the rotation of the shaft portion as shown in FIG. 2.

The embodiment illustrated in FIG. 1 to 4 could be modified by having the driving nut portion 20 formed on the end of the sleeve device and the complementary socket 22 formed in the handle 12. However, an advantage of the illustrated embodiment is that a spanner can be applied to the nut portion formed beneath the handle for extra torque whereas this would not be possible with the reversed arrangement.

The metal liner 18, if made of a ferrous material, may be magnetised to retain ferrous screws within it by magnetic attraction. In an arrangement otherwise than that illustrated in FIG. 5, that is to say provided with a spring 24, this could also be useful in lightly retaining the sleeve device in a required position along the screwdriver blade. Furthermore, the front end of the sleeve device could be fitted with an elastomeric abutment member to protect any vulnerable surface with which it might come into contact and to avoid slipping.

The sleeve device could incorporate an adjustable torque device by means of which, after a screw has been first driven home by the screwdriver handle it could be 'torqued up' to the desired setting by said sleeve device.

Thus there is provided a screwdriver, or sleeve device for fitment to a screwdriver, by means of which the task of driving a screw is considerably simplified and made safer. The sleeve device protects the user against injury when trying to start a screw. It is particularly useful when using screws which are too small to hold between finger and thumb or when securing screws in small or inaccessible spaces.

What I claim is:

1. A screwdriver having a shaft portion with a blade at one end and having also a sleeve device slidably mounted on said shaft portion between a first position of adjustment in which it extends beyond the end of said blade and a second position of adjustment in which it exposes said blade, non-circular plug and socket coupling structures respectively formed on one of said shaft portion and said sleeve device whereby, at least when the blade is exposed, said sleeve device is capable of being coupled to said shaft portion for co-rotation therewith.

2. A screwdriver as claimed in claim 1, in which spring means are provided for urging the sleeve device towards said first position.

3. A as claimed in claim 1, in which the sleeve device is made of a synthetic plastics material having a bore with a metal liner extending at least partly along the length of said bore.

4. A screwdriver as claimed in claim 3 in which said bore of said sleeve device is a stepped bore, whereby said sleeve device is held captive on the shaft portion of the screwdriver by a greater width of the blade.

5. A screwdriver as claimed in claim 1 in which said metal liner is magnetised to retain ferrous screws within it by magnetic attraction.

6. A screwdriver as claimed in claim 1, in which the non-circular plug and socket coupling structures comprise a driving nut portion formed on the shaft portion and a complementary socket at the rear end of the sleeve device.

* * * * *